US010767238B2

(12) United States Patent
Liptak

(10) Patent No.: US 10,767,238 B2
(45) Date of Patent: Sep. 8, 2020

(54) GRAY CAST IRON INOCULANT

(71) Applicant: Elkem AS, Oslo (NO)

(72) Inventor: Matthew Liptak, Ooltewah, TN (US)

(73) Assignee: ELKEM ASA, Oslo (NO)

( * ) Notice: Subject to any disclaimer, the term of this patent is extended or adjusted under 35 U.S.C. 154(b) by 582 days.

(21) Appl. No.: 15/099,897

(22) Filed: Apr. 15, 2016

(65) Prior Publication Data

US 2017/0298481 A1 Oct. 19, 2017

(51) Int. Cl.

| | |
|---|---|
| ***C22C 33/00*** | (2006.01) |
| ***C21C 1/08*** | (2006.01) |
| ***C22C 33/08*** | (2006.01) |
| ***C22C 37/10*** | (2006.01) |

(52) U.S. Cl.
CPC ..... *C21C 1/08* (2013.01); *C22C 33/08* (2013.01); *C22C 37/10* (2013.01)

(58) Field of Classification Search
CPC ..... C21C 1/08; C21C 7/0006; C22C 38/02
USPC ..... 420/578, 581, 78
See application file for complete search history.

(56) References Cited

U.S. PATENT DOCUMENTS

| | | | | |
|---|---|---|---|---|
| 2,280,286 A * | 4/1942 | Critchett | ..... | C21C 5/00 420/581 |
| 2,290,273 A * | 7/1942 | Burgess | ..... | C21C 1/08 420/30 |
| 3,333,954 A | 8/1967 | Dawson | | |
| 3,527,597 A | 9/1970 | Dawson | | |
| 4,666,516 A | 5/1987 | Hornung et al. | | |
| 4,749,549 A * | 6/1988 | Hornung | ..... | C22C 33/08 420/117 |

FOREIGN PATENT DOCUMENTS

| | | | |
|---|---|---|---|
| CN | 103993219 | A | 8/2014 |
| EP | 0004922 | A1 | 10/1979 |
| GB | 1002107 | A | 8/1965 |
| WO | 2017179995 | A1 | 10/2017 |

OTHER PUBLICATIONS

International Search Report for Corresponding International Application No. PCT/NO2017/050093 (10Pages) (Jul. 3, 2017).

* cited by examiner

*Primary Examiner* — Erin B Saad
(74) *Attorney, Agent, or Firm* — Lucas & Mercanti, LLP

(57) ABSTRACT

A ferrosilicon inoculant for gray cast iron containing between 0.1 to 10% by weight strontium, less than 0.35% by weight calcium, 1.5 to 10% by weight aluminum and 0.1 to 15% zirconium, The inoculant, method for producing the inoculant, method for inoculating the melt and a gray cast iron inoculated with the inoculant are covered.

4 Claims, 5 Drawing Sheets

FIG. 1A

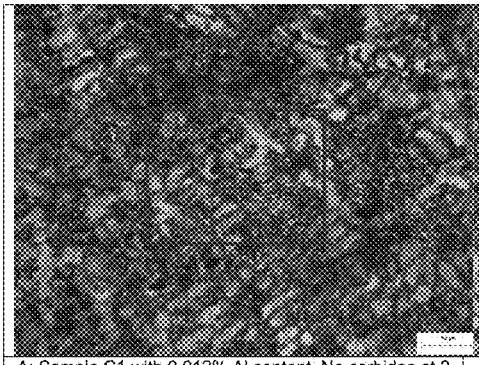

A: Sample C1 with 0.012% Al content. No carbides at 2 mm.

FIG. 1B

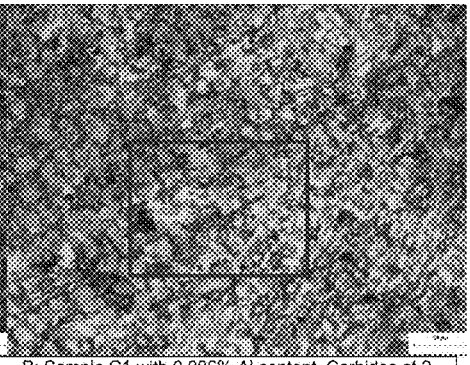

B: Sample C1 with 0.006% Al content. Carbides at 2 mm.

FIG. 1C

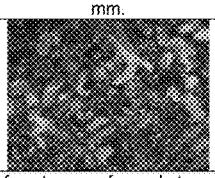

C: Close up of centre area framed above showing that structure is carbide free.

FIG. 1D

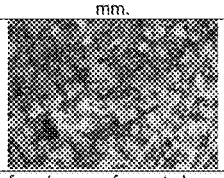

D: Close up of centre area framed above showing that structure contains carbides.

FIG. 1E

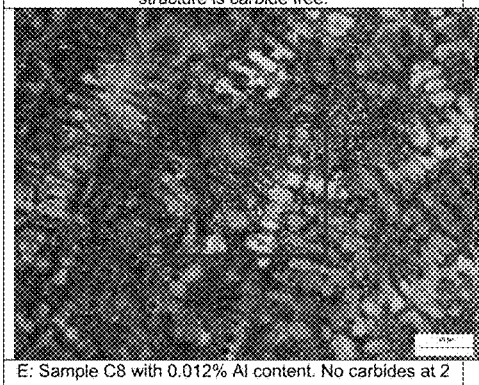

E: Sample C8 with 0.012% Al content. No carbides at 2 mm

FIG. 1F

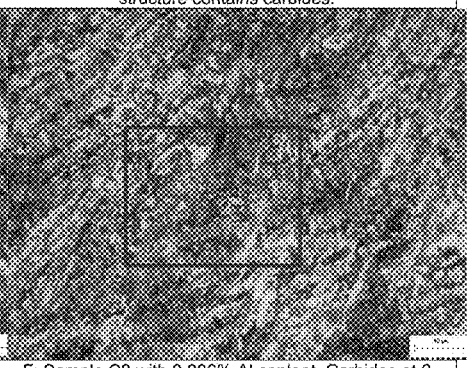

F: Sample C8 with 0.006% Al content. Carbides at 2 mm.

FIG. 1G

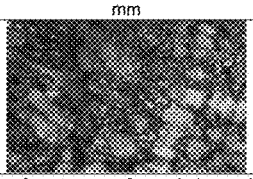

G: Close up of centre area framed above showing that structure is carbide free.

FIG. 1H

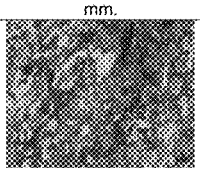

H: Close up of centre area framed above showing that structure contains carbides Slag build up in pouring unit – same corner is marked with red circle

FIG. 2

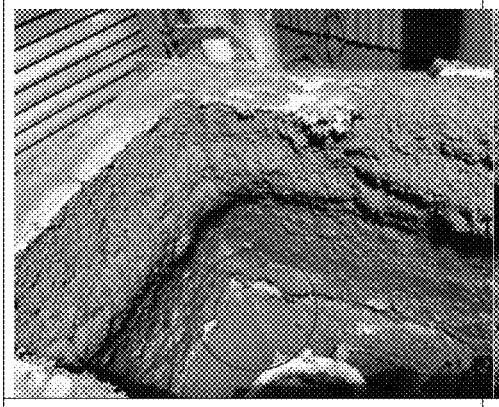

Figure 2: After a few hours use with the nozzle area still free.

FIG. 3

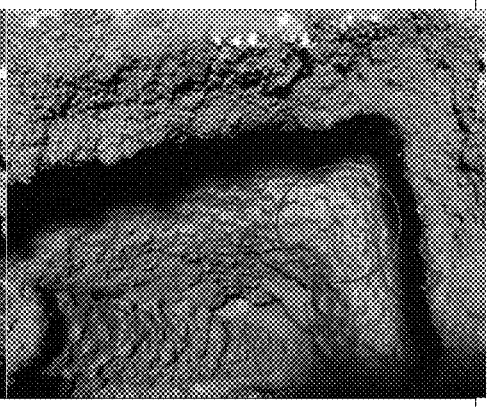

Figure 3: Pouring unit taken out of service due to slag build up.

FIG. 4

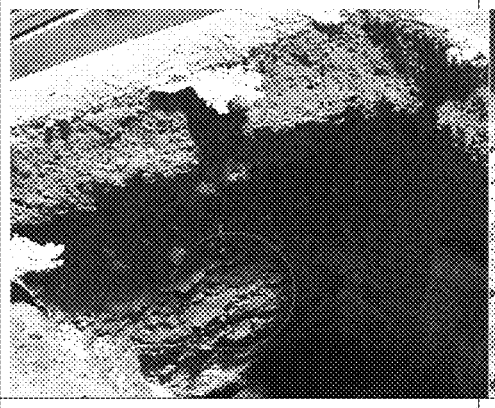

Figure 4: Pouring unit after change to new inoculant system showing minimal slag build up similar to the picture above. Notice the difference in smoothness of the wall below the top slag rim.

FIG. 5

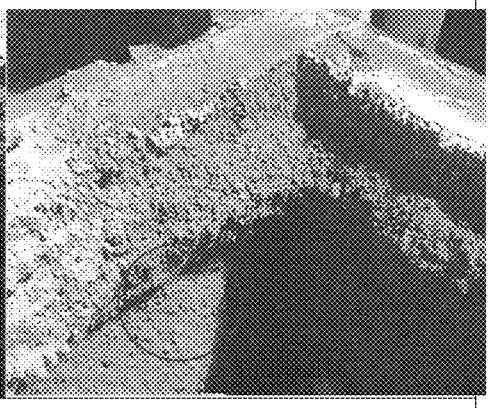

Figure 5: Pouring unit after change to new inoculant system showing minimal slag build up similar to the picture above. Notice the difference in smoothness of the wall below the top slag rim.

FIG. 7
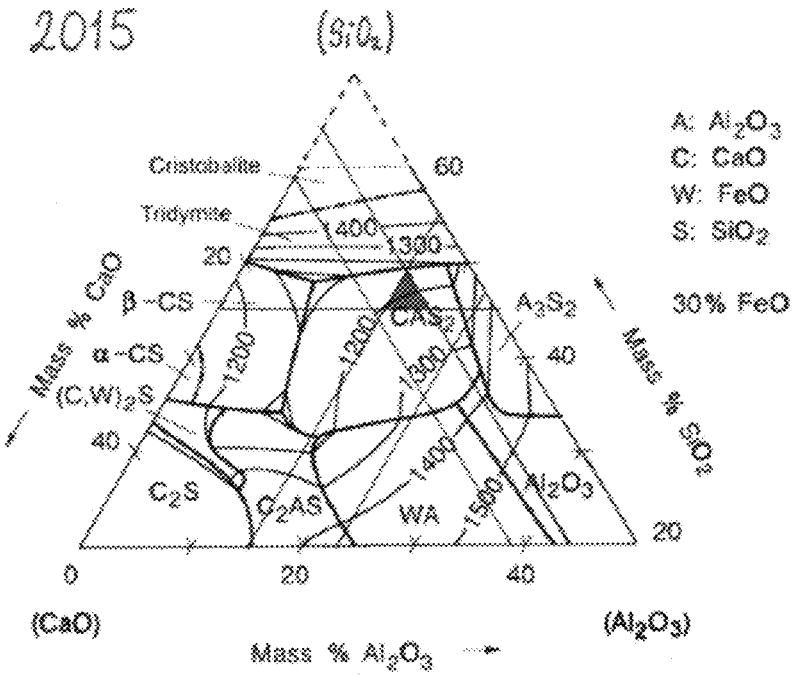
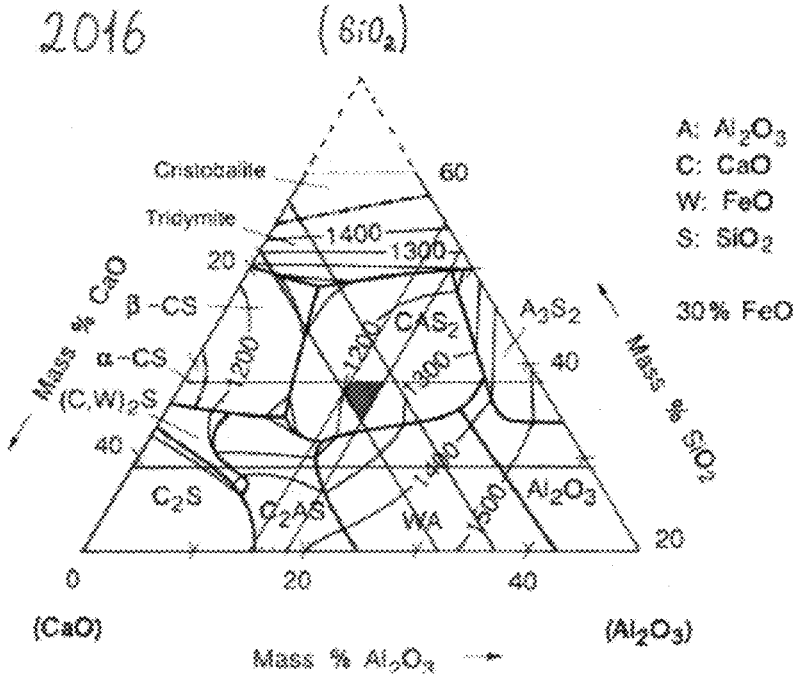

GRAY CAST IRON INOCULANT

BACKGROUND OF THE INVENTION

The invention relates to the manufacture of cast iron and more particularly to an inoculant for gray cast iron to improve the overall properties thereof.

Cast iron is typically produced in a cupola or induction furnace, and generally has about 2 to 4 percent carbon. The carbon is intimately mixed in with the iron and the form which the carbon takes in the solidified cast iron is very important to the characteristics of the cast iron. If the carbon takes the form of iron carbide, then the cast iron is referred to as white cast iron and has the physical characteristics of being hard and brittle which in certain applications is undesirable. If the carbon takes the form of graphite, the cast iron is soft and machine-able and is referred to as gray cast iron.

Graphite may occur in cast iron in the flake, vermicular, nodular or spherical forms and variations thereof. The nodular or spherical form produces the highest strength and most ductile form of cast iron.

The form that the graphite takes as well as the amount of graphite versus iron carbide, can be controlled with certain additives that promote the formation of graphite during the solidification of cast iron. These additives are referred to as inoculants and their addition to the cast iron as inoculation. In cast iron production the foundries are constantly plagued by the formation of iron carbides in thin sections of the castings. The formation of iron carbide is brought about by the rapid cooling of the thin sections as compared to the slower cooling of the thicker sections of the casting. The formation of iron carbide in a cast iron product is referred to in the trade as "chill". The formation of chill is quantified by measuring "chill depth" and the power of an inoculant to prevent chill and reduce chill depth is a convenient way in which to measure and compare the power of inoculants.

As the industry develops there is a need for stronger materials. This means more alloying with carbide promoting elements such as Cr, Mn, V, Mo etc., and thinner casting sections and lighter design of castings. There is therefore a constant need to develop inoculants that reduce chill depth and improve machinability of gray cast iron.

Since the exact chemistry and mechanism of inoculation and why inoculants function as they do, is not completely understood, a great deal of research goes into providing the industry with a new inoculant.

It is thought that calcium and certain other elements suppress the formation of iron carbide and promote the formation of graphite. A majority of inoculants contain calcium. The addition of these iron carbide suppressants is usually facilitated by the addition of a ferrosilicon alloy and probably the most widely used ferrosilicon alloys are the high silicon alloy containing 75 to 80% by weight silicon and the low silicon alloy containing 45 to 50% by weight silicon.

U.S. Pat. No. 3,527,597 discovered that good inoculating power is obtained with the addition of between about 0.1 to 10% by weight strontium to a silicon-bearing inoculant which contains less than about 0.35% by weight calcium and up to 5% by weight aluminum. U.S. Pat. No. 3,527,597 is incorporated herein by reference.

U.S. Pat. No. 4,749,549 provided an inoculant consisting essentially of about 15 to 90% by weight silicon, about 0.1 to 10% by weight strontium, less than about 0.35% by weight calcium, up to about 5% by weight aluminum, not more than about 30% by weight copper, one or more additives selected from about 0.1 to 15% by weight zirconium and about 0.1 to 20% by weight titanium, and a balance of iron, with residual impurities in the ordinary amount. U.S. Pat. No. 4,749,549 is incorporated herein by reference.

Also a method for making an inoculant for cast-iron by adding a strontium rich material and material rich in one or more additives selected from zirconium, titanium alone or in combination to a molten ferrosilicon low in calcium at a sufficient temperature and for a sufficient period of time to cause the desired amount of strontium to enter the ferrosilicon is provided in U.S. Pat. No. 4,666,516, which is incorporated herein by reference.

Superseed® Extra inoculant, a ferrosilicon alloy with (1.0-1.5% by weight Zr, 0.6-1.0%; by weight Sr, 0.1% max by weight Ca and less than 0.5° %; by weight Al) has been used successfully for several years to make thin walled, high strength gray iron castings.

However, for some cast irons it is desirable to increase the aluminum content of the cast iron to at least 0.01% by weight in order to reduce chill in thin walled gray iron castings. In order to achieve this, Alinoc® inoculant (a ferrosilicon alloy with 3.5-4.5% by weight Al, 0.5-1.5% by weight Ca) has been added to the cast iron in the transfer ladle to increase aluminum content of the cast iron followed by addition of Superseed® Extra inoculant in the pouring ladle to reduce chill in new generation, thin walled gray iron castings.

However, this has shown to create problems due to slag build up in the pouring unit probably caused by the high calcium content in the Alinoc® inoculant. The pouring unit can thus only be used for a limited number of cast iron melts and thus adds to the costs for producing cast iron products. There is thus a need for an inoculant with a higher aluminum content and a low calcium content that can be used as the only inoculant added to the cast iron in the transfer ladle, in the pouring unit or in the molten cast iron stream.

SUMMARY OF THE INVENTION

It has been found that aluminum content control is critical for producing chill free gray iron castings. Chill relates to how the casting design promotes iron carbide in the cast microstructure, most times a condition not desired.

It has further been found that high strength irons can be produced by controlling aluminum as well.

It has also been found that reducing the amount of calcium in the inoculant to less than 0.5% by weight is critical to alleviating slag build up in the pouring unit. It has been found that by adding aluminum to an inoculant that has little or no calcium and inoculating the molten gray iron in the transfer ladle or in the pouring unit, the chill is reduced in thin walled castings and at the same time the amount of slag build up on the transfer ladle and in the pouring unit is reduced.

The inoculant of the present invention can be defined as a ferrosilicon inoculant for cast iron consisting essentially of about 15 to 90% by weight silicon; about 0.1 to 10% by weight strontium; less than about 0.35% by weight calcium; about 1.5 to about 10% by weight aluminum; about 0.1 to 15% by weight zirconium; and a balance of iron, with residual impurities in the ordinary amount.

The inoculant of the present invention is suitably added to the molten gray cast iron in the transfer ladle, the transfer ladle being the holder used between the furnace and the mold. It can also added to the pouring unit as well as to the molten cast iron stream when pouring the cast iron or into the molds.

The inoculant can be added as the only inoculant or together with other inoculants like Superseed® Extra inoculant to the molten gray cast iron in the transfer ladle or thereafter during the pouring process. Also, it is suitable that the inoculant of the present invention is added only once.

It has now been discovered that the inoculant with higher aluminum content improved gray iron microstructures (higher cell count, lower carbide content, higher perlite content) and material mechanical properties without added cost of slag removal or the use of secondary alloys, providing that aluminum content of 0.010% by weight molten cast iron was obtained.

Removing calcium from the inoculation system by using the inoculant of the present invention as the only inoculant was truly surprising and unexpected in its ability to reduce chill and slag formation in the transfer ladle and consequently reduced slag build up in the pouring unit.

BRIEF DESCRIPTION OF THE DRAWINGS

FIGS. 1 A, C, E and G show the results with 0.006% aluminum in the cast iron.

FIGS. 1 B, D, F and H show the result with 0.012% aluminum in the cast iron.

FIG. 2 shows the pouring unit with low hours on it.

FIG. 3 shows the pouring unit with slag build-up.

FIG. 4 shows pouring unit with low slag build-up when inoculant according to the invention is used.

FIG. 5 shows another pouring unit with low slag build-up when inoculant according to the invention is used

FIG. 7 shows phase diagrams for slag compositions according to prior art and according to the invention.

DETAILED DESCRIPTION OF THE INVENTION

Figure 6:
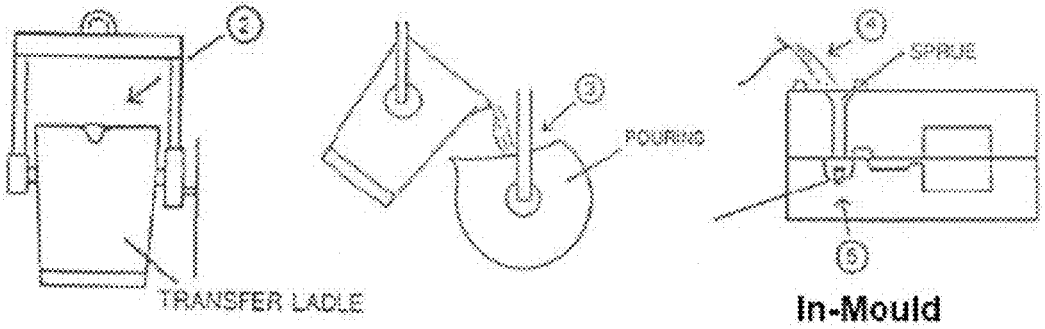
FIG. 6 shows how inoculants are generally added to cast iron.

It was been found that the aluminum content in the inoculant should be about 1.5 to 10.0% by weight and more preferably about 2 to 6% by weight.

In accordance with the present invention, the strontium content in the inoculant of the present invention should be between about 0.1 to 10% by weight. Preferably the inoculant contains about 0.4 to 4% by weight strontium content or between about 0.4 to 1% by weight. A good commercial inoculant has about 1% by weight strontium.

In accordance with the present invention, the amount of zirconium should be between 0.1 to 15% and preferably between about 0.1 to 10%. Best results will be obtained with a zirconium content of about 0.5 to 2.5%.

Also in accordance with the present invention, the calcium content must not exceed about 0.35% and preferably is below about 0.15%. Best results are obtained when the calcium content is below about 0.1%.

The amount of silicon in the inoculant should be about 15 to 90% and preferably about 40 to 80% by weight of inoculant.

The balance of the inoculant is iron with residual impurities in the ordinary amount.

The inoculant of the present invention can be made in any conventional manner with conventional raw materials. Generally, a molten bath of ferrosilicon is formed to which a strontium metal or strontium silicide is added along with an aluminum rich material, and a zirconium-rich material; titanium-rich material or both. Preferably, a submerged arc furnace is used to produce a molten bath of ferrosilicon. The calcium content of this bath is conventionally adjusted to drop the calcium content to below the 0.35% by weight level. To this is added aluminum, strontium metal or strontium silicide and a zirconium-rich material. The additions of aluminum, the strontium metal or strontium silicide, zirconium-rich material to the melt are accomplished in any conventional manner. The melt is then cast and solidified in a conventional manner.

The solid inoculant is then crushed in a conventional manner to facilitate its addition to the cast iron melt. The size of the crushed inoculant will be determined by the method of inoculation, for example, inoculant crushed for use in ladle inoculation is larger than the inoculant crushed for stream inoculation. Acceptable results for ladle inoculation is found when the solid inoculant is crushed to a size of about ⅜ inch by down.

An alternative way to make the inoculant is to layer into a reaction vessel silicon, iron, strontium metal or strontium silicide, aluminum and zirconium-rich material and then melt it to form a molten bath. The molten bath is then solidified and crushed as disclosed above.

The base alloy for the inoculant is preferably ferrosilicon which can be obtained in any conventional manner such as forming a melt of quartz and scrap iron in a conventional manner, however, it is also possible to use already formed ferrosilicon or silicon metal and iron.

The silicon content in the inoculant is about 15% to 90% a by weight and preferably about 40% by weight to 80% by weight. When the inoculant is made from a base alloy of ferrosilicon, the remaining percent or balance after all other elements is iron.

Calcium will normally be present in the quartz, ferrosilicon and other additives such that the calcium content of the molten alloy will generally be greater than about 0.35%. Consequently, the calcium content of the alloy will have to be adjusted down so that the inoculant will have a calcium content within the specified range. This adjustment is done in a conventional manner.

The aluminum is added to the inoculant after calcium has been removed.

The exact chemical form or structure of the strontium in the inoculant is not precisely known. It is believed that the strontium is present in the inoculant in the form of strontium silicide ($SrSi_2$) when the inoculant is made from a molten bath of the various constituents. However, it is believed that acceptable forms of strontium in the inoculant are strontium metal and strontium silicide no matter how the inoculant is formed.

Strontium metal is not easily extracted from its principal ores, Strontianite, strontium carbonate, ($SrCO_3$) and Celesite, strontium sulfate, ($SrSO_4$). It is not economically practical to use strontium metal during the production process of the inoculant and it is preferred that the inoculant is made with strontium ore.

U.S. Pat. No. 3,333,954 discloses a convenient method for making a silicon bearing inoculant containing acceptable forms of strontium wherein the source of strontium is strontium carbonate or strontium sulfate. The carbonate and sulfate are added to a molten bath of ferrosilicon. The addition of the sulfate is accomplished by the further addition of a flux. A carbonate of an alkali metal, sodium hydroxide and borax are disclosed as appropriate fluxes. The method of the '954 patent encompasses adding a strontium-rich material to a molten ferrosilicon low in calcium at a sufficient temperature and for a sufficient period of time to cause the desired amount of strontium to enter the ferrosilicon. U.S. Pat. No. 3,333,954 is incorporated herein by reference and discloses a suitable way to prepare a silicon-bearing inoculant containing strontium to which an aluminum rich material is added and either a zirconium-rich material, a titanium-rich material or both can be added to form the inoculant of the present invention. The addition of the aluminum rich material and zirconium-rich material, titanium-rich material or both can be accomplished by adding these materials to the molten bath of ferrosilicon either before, after or during the addition of the strontium-rich material. The addition of the aluminum rich material and the zirconium-rich material, titanium-rich material or both is accomplished in any conventional manner.

There are the normal amount of trace elements or residual impurities in the finished inoculant. It is preferred that the amount of residual impurities be kept low in the inoculant.

In the specification and claims, the percent of the elements are weight percent based on the solidified final product inoculant unless otherwise specified.

It is preferred that the inoculant be formed from a molten mixture of the different constituents as described heretofore, however, some improvement in chill depth is experienced by making the inoculant of the present invention in the form of a dry mix or briquette that includes all of the constituents without forming a molten mix of the constituents. It is also possible to use two or three of the constituents in an alloy and then add the other constituents either in a dry form or as briquettes to the molten iron bath to be treated. Thus, it is within the scope of this invention to form silicon-bearing inoculant containing strontium and use it with an aluminum, and a zirconium-rich material.

The addition of the inoculant to the cast iron is accomplished in any conventional manner. For example, as provided in FIG. 6 the inoculant can be added to the transfer ladle, to the pouring unit (2), to the stream of cast iron (3) as it enters the mold, and using an insert placed inside the mold runner system.

Preferably the inoculant is added as close to final casting as possible. Typically, ladle and stream inoculation are used to obtain very good results. Mold inoculation may also be used. Stream inoculation is the addition of the inoculant to molten stream as it is poured into the mold.

The amount of inoculant to add will vary and conventional procedures can be used to determine the amount of inoculant to add. Acceptable results have been found by adding between 0.3 and 0.6% inoculant based on the weight of cast iron when using ladle inoculation.

Although the discussion heretofore has dealt primarily with the addition of the inoculant of the present invention to cast iron to produce gray cast iron, it is likewise possible to add the inoculant of the present invention to reduce chill in ductile iron.

The following examples illustrate the present invention.

EXAMPLES

It is readily apparent that the inoculants of the present invention produces far superior results to that of the conventional commercial inoculant or to the untreated sample.

It will be understood that the preferred embodiments of the present invention herein chosen for the purpose of illustration are intended to cover all changes and modifications of the preferred embodiments of the present invention which do not constitute a departure from the spirit and scope of the present invention.

Example 1

First rounds of testing used an inoculant according to the present invention containing 2% by weight aluminum in the alloy. Iron castings were produced with acceptable levels of carbides and slag buildup was not a problem. Below is a round of testing showing the difference between final aluminum of 0.006% and 0.012% Al in the cast iron, with the former being fully carbidic and the latter having carbide free or only trace amounts of carbide which is acceptable in this casting. No other significant changes were made to the process. FIG. 1 illustrates the results. No carbides were found in samples A and E inoculated with the inoculant according to the present invention. As can be seen from samples B and F in FIG. 1 the cast iron structure contains carbide.

Example 2

The occurrence of a hard slag buildup developed shortly after adding an inoculant (Alinoc®) with a calcium content of 0.5 to 1.5%, mainly occurring under the iron level on the walls of the pouring unit leading to shortened life and extra cleaning costs. FIG. 2 illustrates a pouring unit with low hours of use, while FIG. 3 illustrates a pouring unit with build-up of slag on the sidewalls when Alinoc® inoculant where added to the transfer ladle and Superseed® Extra inoculant with Al content <0.5% by weight were added to the pouring unit.

One test was done with inoculating the cast iron melt with Superseed® Extra inoculant with Al content <0.5% by weight and with the inoculant according to the present invention together with Superseed® Extra inoculant with Al content <0.5% by weight. As shown in FIGS. 4 and 5 little or no slag build-up was found in the pouring unit.

Since molten cast-iron and slag coexists it was desirable to look at the chemistry of the slag in pouring unit. A baseline was taken to approximate what occurs when no Alinoc® inoculant is used in the transfer ladle and 0.5% by weight Superseed® Extra inoculant with Al content <0.5% by weight is added to the cast iron in the transfer ladle (Base line). One sample were taken with the revised process (0.125% Alinoc® inoculant and 0.375% Superseed® Extra inoculant with <0.5% by weight Al) (Sample 2015) and one sample were taken with the use of the inoculant according to the present invention containing 2% by weight aluminum. (Sample 2016) Samples were taken from the pouring unit just after transfer of new iron. The slag compositions are shown in Table 1.

TABLE 1

Slag compositions
Composition range for slag found in Pouring Unit

| | $SiO_2$ | FeO + MnO | $Al_2O_3$ | CaO + SrO + MgO |
|---|---|---|---|---|
| Base line | 45 | 25-30 | 15-20 | 6-10 |
| 2015 | 45 | 25-30 | 16-23 | 8-11 |
| 2016 | 29-38 | 30-35 | 15-18 | 13-18 |

As can be seen from Table 1, the Base line slag and the 2015 slag have about the same compositions. The slag from the Sample 2016 using the inoculant of the present invention is, however, lower in $SiO_2$ and higher in FeO and MnO. The slag compositions for Sample 2015 and Sample 2016 were plotted in a phase diagram for $SiO_2$, CaO and $Al_2O_3$ for 30% FeO. The results are shown in FIG. 7. The slag compositions are shown as red marked triangles in the phase diagrams. It can be seen from FIG. 7 that the composition of the slag has moved from tridymite in the Sample 2015 towards a slag richer in FeO and $Al_2O_3$ for Sample 2016 inoculated with the inoculant according to the invention. Sample 2016 slag composition provides a less hard and less tough slag that is easier to remove than the tridymite slag of Sample 2015.

This change in slag composition is most likely related to the change in inoculation system, which has shifted the slag composition to be richer in Al, Sr and Zr and effectively moved the slag composition away from Tridymite.

The needed aluminum can be added to inoculating alloys such as Superseed® Extra inoculant in concentrations that provide efficient means to get the needed aluminum levels in the liquid gray iron to improve iron quality. Slag generation due to this method of aluminum addition will be reduced and provide a chemistry that is more easily dealt with. By combining the aluminum addition with the inoculation step a more economical solution is also possible.

The addition of Alinoc® inoculant; however, introduces calcium as well which led to slag build up problems. A study of the slags showed that calcium had shifted to a slag that caused faster slag build-up in the pouring unit. A batch of Superseed® Extra inoculant with 2% aluminum was produced and run with no problems with slag build up while still maintaining the improved microstructures.

In a two-step process, inoculating agents are added in two places, generally to the transfer ladle as it is filled and in the pouring stream when the mold is filled to produce the casting. On the other hand, a one-step process according to the invention, the inoculating agent is added only in one place, such as in the transfer ladle as it is filled.

Slag control in iron transfer vessels and pouring units is a constant problem foundries deal with every day and by adding additional elements, such as calcium in the Alinoc® inoculant, the slag chemistry is affected. The chemistry change produces heavy slag buildup that is very hard to remove. Using the inoculant of the present invention with increased aluminum content, the aluminum input can be controlled without the input of calcium creating the slag buildup.

Example 3

Two different inoculants according to the invention were produced.

Inoculant A had the following composition: 73.1% by weight Si, 1.94% by weight Al, 0.10% by weight Ca, 1.19% by weight Zr, 0.99% by weight Sr, the remaining being Fe.

Inoculant B had the following composition: 71.3% by weight Si, 4.4% by weight Al, 0.085 Ca, 1.27% by weight Zr, 0.98% by weight Sr, the remaining being iron.

Inoculant A according to the invention was added to a cast iron melt in the pouring ladle as the only inoculant in an amount of 0.3% by weight based on the weight of the base cast iron and Inoculant B was added to a cast iron melt in the pouring ladle as the only inoculant in an amount of 0.3% by weight based on the weight of the base cast iron.

For comparison purposes the base cast iron was inoculated with Superseed® Extra inoculant containing less than 0.5% by weight Al, denoted Inoculant C.

The base cast iron had the following composition: 3.45° % by weight C, 1.82% by weight Si, 0.071% by weight S, 0.049% by weight P, 0.0039% by weight.

The final compositions of the cast irons inoculated with Inoculant A, Inoculant B and prior art Inoculant C are shown in Table 2.

TABLE 2

| | Final iron (wt %) | | | | | | | | | | |
|---|---|---|---|---|---|---|---|---|---|---|---|
| | Element | | | | | | | | | | |
| | C % | Si % | S % | P % | Mn % | Ti % | Al % | Cr % | Sn % | Sb % | Cu % |
| Target | 3.35 ± 0.20 | 2.05 ± 0.20 | 0.070 ± 0.005 | 0.050 ± 0.015 | 0.60 ± 0.10 | Max 0.010 | 0.0030 | 0.13 ± 0.010 | 0.12 ± 0.02 | 0.057 ± 0.013 | 0.50 ± 0.05 |
| Inoculant B | 3.32 | 2.00 | 0.072 | 0.051 | 0.59 | 0.004 | 0.012 | 0.14 | 0.12 | 0.057 | 0.51 |
| Inoculant A | 3.42 | 2.01 | 0.071 | 0.050 | 0.59 | 0.004 | 0.0068 | 0.14 | 0.12 | 0.057 | 0.51 |
| Inoculant B | 3.44 | 1.98 | 0.071 | 0.051 | 0.59 | 0.004 | 0.0117 | 0.14 | 0.12 | 0.058 | 0.51 |
| Inoculant C | 3.44 | 2.07 | 0.071 | 0.048 | 0.59 | 0.004 | 0.0036 | 0.14 | 0.12 | 0.056 | 0.50 |
| Inoculant A | 3.42 | 2.04 | 0.072 | 0.050 | 0.59 | 0.004 | 0.0066 | 0.14 | 0.12 | 0.058 | 0.51 |

The aim was to obtain a target level of at least 0.010% by weight aluminum in the final cast iron as well as low chill and good mechanical properties. As can be seen from Table 3, the targeted aluminum content was obtained by the addition of Inoculant B containing 4.4% by weight aluminum. The addition of Inoculant A in an amount of 0.3% based on the cast iron did not reach the target aluminum content. In order to reach the target aluminum content more than 0.3 of Inoculant A have to be added. Inoculant C according to the prior art did, as expected, not provide any increase in the aluminum content of the cast iron.

Wedges were cast to determine chill depth for the casting inoculated with Inoculant A, Inoculant B and Inoculant C. The results are shown in Table 4.

TABLE 4

| Inoculant | Chill, mm | Chill, mm | Comment |
|---|---|---|---|
| Inoculant B | 2.1 | 2 | Hint of carbides in upper corners |
| Inoculant A | 1.9 | 2 | Hint of carbides in upper corners |
| Inoculant B | 1.4 | 1 | Hint of carbides in upper corners |
| Inoculant A | 3.5 | 4 | Hint of carbides in upper corners |
| Inoculant C | 2.5 | 3 | Hint of carbides in upper corners |

From Table 4 it can be seen that Inoculant B with an aluminum content of 4.4% by weight based on the weight of base iron resulted in a very low chill depth.

Tensile strength were measured for the cast irons inoculated with Inoculant A, Inoculant B and prior art Inoculant C. The results for yield strength and ultimate strength are shown in FIG. 8.

Figure 8:
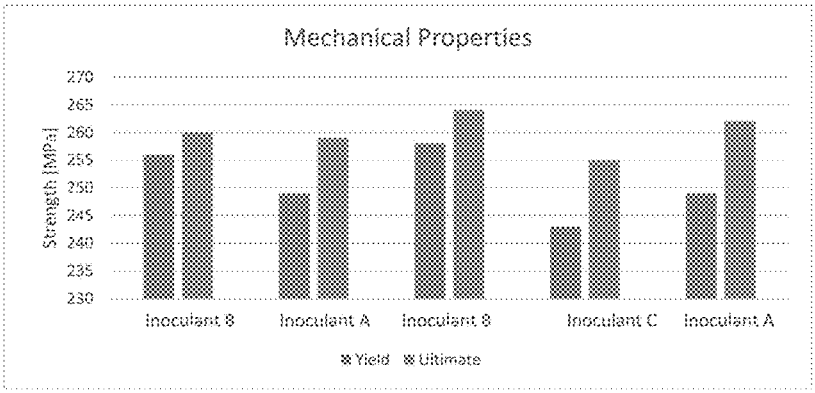
FIG. 8 shows tensile strength for cast iron samples inoculated with inoculant described in Example 3.

It can be seen from FIG. 8 that the cast irons inoculated with Inoculant B have appreciably higher yield strength and ultimate strength than the cast irons inoculated with Inoculant A, while the cast iron inoculated with prior art Inoculant C showed the lowest yield strength and ultimate strength.

The invention claimed is:

1. A ferrosilicon inoculant for cast iron consisting of
about 15 to 90% by weight silicon;
about 0.1 to 10% by weight strontium;
less than about 0.35% by weight calcium;
about 1.5 to 10.0% by weight aluminum;
about 0.1 to 15% by weight zirconium, and
a balance of iron with residual impurities.

2. The ferrosilicon inoculant according to claim 1, wherein the silicon is present in an amount of about 40 to 80% by weight.

3. The ferrosilicon inoculant according to claim 1, wherein the aluminum is present in about 2-6% by weight.

4. The ferrosilicon inoculant according to claim 1, wherein the aluminum is present in about 2-4% by weight.

* * * * *